US009341424B2

(12) United States Patent
Allan

(10) Patent No.: US 9,341,424 B2
(45) Date of Patent: May 17, 2016

(54) FIREARM LOCKING ASSEMBLY

(71) Applicant: Robert M. Allan, La Jolla, CA (US)

(72) Inventor: Robert M. Allan, La Jolla, CA (US)

(73) Assignee: SAFETY FIRST ARMS, LLC, San Diego, CA (US)

( * ) Notice: Subject to any disclaimer, the term of this patent is extended or adjusted under 35 U.S.C. 154(b) by 45 days.

(21) Appl. No.: 13/916,370

(22) Filed: Jun. 12, 2013

(65) Prior Publication Data

US 2014/0366419 A1 Dec. 18, 2014

(51) Int. Cl.
*F41A 17/06* (2006.01)
*F41A 17/46* (2006.01)

(52) U.S. Cl.
CPC ..... *F41A 17/063* (2013.01); *F41A 17/06* (2013.01); *F41A 17/46* (2013.01)

(58) Field of Classification Search
CPC ..... F41C 27/00; F41C 3/08; F41A 35/00; F41A 17/00; F41A 17/06; F41A 17/04; F41A 17/46; F41A 23/16; F41A 9/62; F41A 29/00; F41A 9/65; F41A 9/67; F41A 9/70; F41A 17/063; F41B 11/53; F41B 11/57; F41B 9/0075; F41G 1/345; F41G 1/54; F41G 1/05
USPC ..... 42/70.06, 70.04
See application file for complete search history.

(56) References Cited

U.S. PATENT DOCUMENTS 2,327,334 A 8/1943 Parker
3,634,963 A 1/1972 Hermann
4,467,545 A * 8/1984 Shaw, Jr. ..... G07C 9/00158 42/70.01
4,541,191 A * 9/1985 Morris ..... F41A 17/06 42/1.01
5,020,259 A 6/1991 Mossberg
5,357,704 A 10/1994 Benkovic
5,448,847 A * 9/1995 Teetzel ..... F41A 17/08 42/70.05
5,449,103 A * 9/1995 Tilley ..... F41A 17/063 224/244
5,502,915 A * 4/1996 Mendelsohn ..... F41A 17/066 42/70.11
5,621,996 A 4/1997 Mowl, Jr.
5,735,070 A * 4/1998 Vasquez ..... F41G 1/345 42/1.02
5,860,241 A 1/1999 Waters
6,125,568 A 10/2000 Granaroli
6,286,242 B1 * 9/2001 Klebes ..... F41A 19/58 42/70.01
6,293,039 B1 * 9/2001 Fuchs ..... F41A 17/066 42/70.04
6,442,880 B1 * 9/2002 Allan ..... F41A 17/066 42/66
6,735,897 B1 * 5/2004 Schmitter ..... F41A 17/063 42/70.01
6,943,665 B2 9/2005 Chornenky
7,155,034 B1 12/2006 Recce
7,168,198 B2 * 1/2007 Newkirk ..... F41A 17/06 42/70.01
7,216,449 B2 5/2007 Riebling et al.
7,339,456 B1 * 3/2008 Buckley ..... F41A 17/063 340/5.51
7,353,632 B2 * 4/2008 Newkirk ..... F41A 17/06 224/243
7,506,468 B2 * 3/2009 Farrell ..... F41A 17/06 42/70.01

(Continued)

*Primary Examiner* — Troy Chambers
*Assistant Examiner* — Bridget Cochran

(57) ABSTRACT

A firearm locking assembly combines a firearm and a locked safety assembly and is configured to allow owner and deny non-owner use. The assembly allows owner unencumbered use without an alarm sounding. The assembly allows owner very fast unlocking without the use of anything external, except the owner's hands. Motion detector and alarm plus trigger lock guard against the firearm being taken to a school, public place, or unauthorized use and theft. The assembly includes automatic locking if the firearm it is put down or forcefully taken away. The assembly includes means for a multiple position safety lever to signal: 1) if firearm is locked, 2) if firearm ready to accept code, 3) if firearm is unlocked, and 4) if firearm is in timed unlocked mode. The assembly also includes law enforcement and military modes, audio and silent FM alarm, a GPS and a digital camera.

17 Claims, 7 Drawing Sheets

(56) References Cited

U.S. PATENT DOCUMENTS 7,703,229 B2 * 4/2010 Parhofer et al. ..... 42/70.01
7,966,759 B2 6/2011 Bentley
8,205,372 B2 * 6/2012 Anzeloni ..... F41A 17/063 42/70.01
8,418,391 B2 * 4/2013 Kemmerer ..... F41A 17/066 42/70.05
9,134,083 B2 * 9/2015 Wasmer ..... F41A 17/06
2002/0178635 A1 * 12/2002 Martin ..... F41A 17/06 42/70.11
2005/0066567 A1 * 3/2005 Newkirk ..... F41A 17/06 42/70.11
2005/0188583 A1 * 9/2005 Jackson ..... F41A 17/06 42/70.11
2007/0175955 A1 8/2007 Shelton et al.
2008/0060246 A1 * 3/2008 Rozovsky ..... F41A 17/06 42/70.01
2011/0056108 A1 * 3/2011 McCord ..... F41A 17/066 42/70.01
2011/0061280 A1 * 3/2011 Emde ..... F41A 17/063 42/70.06
2011/0247950 A1 10/2011 McGee
2012/0011756 A1 * 1/2012 Albano Do Amarante ..... F41A 17/066 42/1.01
2013/0019510 A1 * 1/2013 Kemmerer ..... F41A 17/20 42/1.01
2013/0125441 A1 * 5/2013 Westwood ..... F41A 17/02 42/70.05
2013/0167423 A1 * 7/2013 Lupher ..... F41A 17/06 42/70.06
2013/0318847 A1 * 12/2013 Kelly ..... F41A 17/46 42/70.06
2014/0259841 A1 * 9/2014 Carlson ..... F41A 17/063 42/1.01
2015/0040453 A1 * 2/2015 Ballard ..... F41A 17/063 42/70.11
2015/0135935 A1 * 5/2015 Schoenlau ..... F41A 21/30 89/14.4

* cited by examiner

FIREARM LOCKING ASSEMBLY

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to firearms. More particularly, the invention relates to firearms configured to allow owner unhindered use and hinder non-owner use, through the use of a processor, a motor, owners code, the owner's hands, an accelerometer, an alarm, a safety lever and a blocking portion.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that a firearm is a weapon that launches one or more projectile at high velocity through confined burning of a propellant.

Typically, there are several types of trigger locks and safes that serve to make it difficult to use a firearm. Trigger locks are considered less effective than keeping firearms stored in a lockable safe since locks may be easily defeated. Typically firearm trigger locks prevent the firearm trigger from being pulled by fitting over the trigger guard and trigger, and being locked in place with a key. Keys conveniently stored near a firearm kept for personal defense may be easy to locate by an unauthorized person, making the typical trigger lock impractical for preventing unauthorized handling, and attempts to disable the lock. A well hidden key may be difficult to locate at night and thwart a quick response in an emergency. It is estimated over 350,000 firearm are stolen every year. Other than a safe or home security system, a trigger lock, permits the firearm to be stolen.

Typically, there is no practical defense against firearm theft. Stolen firearms often wind up on the street used in other crimes. There are currently no known commercially available firearms suitable for home defense that have an internal defense against being moved, stolen or unauthorized handling, including being taken to a school, other public place or being stolen.

Typically, there are currently no known commercially available firearms suitable for home defense that have an internal trigger lock to prevent unauthorized use by a child or others, that automatically locks the firearm if put down or taken away. Unauthorized use of a firearm requires 1) that it can be moved, and 2) the potential the trigger can be pulled, allowing the firearm to be fired. The instance invention not only defends against the firearm being moved or stolen, but against it being fired.

In view of the foregoing, it is clear that these traditional techniques are far from perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
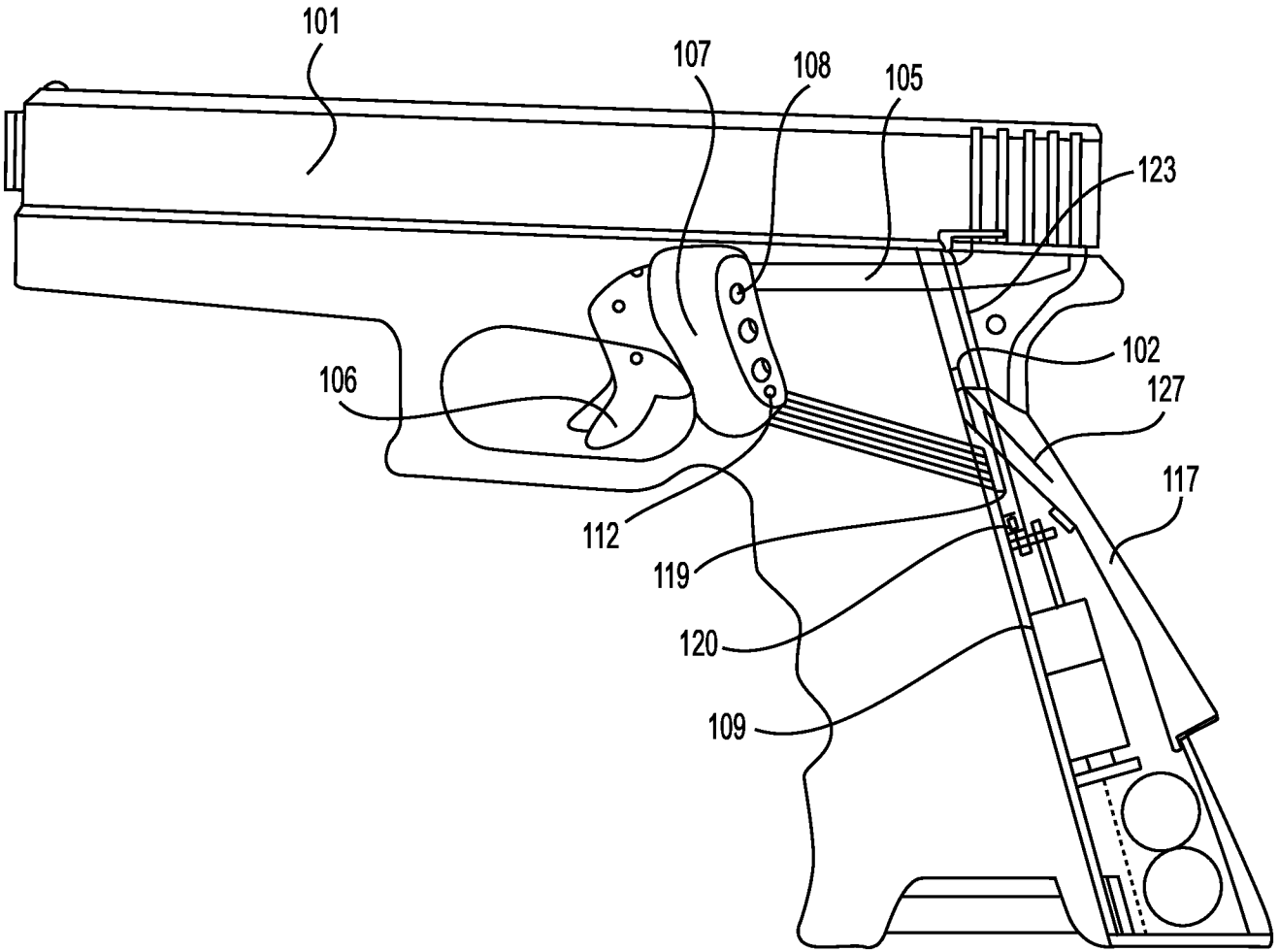
FIG. 1 illustrates a detailed perspective view of an exemplary firearm locking assembly joined with an exemplary firearm in an exemplary locked mode, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include substeps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

A "processor" may refer to one or more apparatus and/or one or more systems that are capable of accepting a structured input, processing the structured input according to prescribed rules, and producing results of the processing as output. Examples of a processor may include: a computer; a stationary and/or portable computer; a computer having a single processor, multiple processors, or multi-core processors, which may operate in parallel and/or not in parallel; a general purpose computer; a supercomputer; a mainframe; a super mini-computer; a mini-computer; a workstation; a microcomputer; a server; a client; an interactive television; a web appliance; a telecommunications device with internet access; a hybrid combination of a computer and an interactive television; a portable computer; a tablet personal computer (PC); a personal digital assistant (PDA); a portable telephone; application-specific hardware to emulate a computer and/or software, such as, for example, a digital signal processor (DSP), a field-programmable gate array (FPGA), an application specific integrated circuit (ASIC), an application specific instruction-set processor (ASIP), a chip, chips, a system on a chip, or a chip set; a data acquisition device; an optical computer; a quantum computer; a biological computer; and generally, an apparatus that may accept data, process data according to one or more stored software programs, generate results, and typically include input, output, storage, arithmetic, logic, and control units.

"Software" may refer to prescribed rules to operate a computer. Examples of software may include: code segments in one or more computer-readable languages; graphical and or/textual instructions; applets; pre-compiled code; interpreted code; compiled code; and computer programs.

A "computer-readable medium" may refer to any storage device used for storing data accessible by a computer. Examples of a computer-readable medium may include: a magnetic hard disk; a floppy disk; an optical disk, such as a CD-ROM and a DVD; a magnetic tape; a flash memory; a memory chip; and/or other types of media that can store machine-readable instructions thereon.

A "computer system" may refer to a system having one or more computers, where each computer may include a computer-readable medium embodying software to operate the computer or one or more of its components. Examples of a computer system may include: a distributed computer system for processing information via computer systems linked by a network; two or more computer systems connected together via a network for transmitting and/or receiving information between the computer systems; a computer system including two or more processors within a single computer; and one or more apparatuses and/or one or more systems that may accept data, may process data in accordance with one or more stored software programs, may generate results, and typically may include input, output, storage, arithmetic, logic, and control units.

A "network" may refer to a number of computers and associated devices that may be connected by communication facilities. A network may involve permanent connections such as cables or temporary connections such as those made through telephone or other communication links. A network may further include hard-wired connections (e.g., coaxial cable, twisted pair, optical fiber, waveguides, etc.) and/or wireless connections (e.g., radio frequency waveforms, free-space optical waveforms, acoustic waveforms, etc.). Examples of a network may include: an internet, such as the Internet; an intranet; a local area network (LAN); a wide area network (WAN); and a combination of networks, such as an internet and an intranet.

Exemplary networks may operate with any of a number of protocols, such as Internet protocol (IP), asynchronous transfer mode (ATM), and/or synchronous optical network (SONET), user datagram protocol (UDP), IEEE 802.x, etc.

Embodiments of the present invention may include apparatuses for performing the operations disclosed herein. An apparatus may be specially constructed for the desired purposes, or it may comprise a general-purpose device selectively activated or reconfigured by a program stored in the device.

Embodiments of the invention may also be implemented in one or a combination of hardware, firmware, and software. They may be implemented as instructions stored on a machine-readable medium, which may be read and executed by a computing platform to perform the operations described herein.

In the following description and claims, the terms "computer program medium" and "computer readable medium" may be used to generally refer to media such as, but not limited to, removable storage drives, a hard disk installed in hard disk drive, and the like. These computer program products may provide software to a computer system. Embodiments of the invention may be directed to such computer program products.

An algorithm is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

Unless specifically stated otherwise, and as may be apparent from the following description and claims, it should be appreciated that throughout the specification descriptions utilizing terms such as "processing," "computing," "calculating," "determining," or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

In a similar manner, the term "processor" may refer to any device or portion of a device that processes electronic data from registers and/or memory to transform that electronic data into other electronic data that may be stored in registers and/or memory. A "computing platform" may comprise one or more processors.

A non-transitory computer readable medium includes, but is not limited to, a hard drive, compact disc, flash memory, volatile memory, random access memory, magnetic memory, optical memory, semiconductor based memory, phase change memory, optical memory, periodically refreshed memory, and the like; however, the non-transitory computer readable medium does not include a pure transitory signal per se.

The present invention will now be described in detail with reference to embodiments thereof as illustrated in the accompanying drawings.

There are various types of firearm locking assemblies that may be provided as preferred embodiments of the present invention. In one embodiment of the present invention, the firearm locking assembly may provide multiple locking modes and integrates into a firearm. The firearm locking assembly may utilize access codes, a grip switch, and a processor to switch between the various locking modes. The firearm locking assembly may utilize a restriction portion. The restriction portion may include a bar that is round, rectangular or square and operable to restrict the backward movement of a firearm trigger or trigger assembly to prevent discharge. However, in other embodiments, the restriction portion may include a mechanical barrier of a variety of shapes and dimensions configured to restrict movement of the trigger. A safety lever may provide a tactile indication whether the firearm is locked. The safety lever may be operable so that it cannot be fully depressed into the firearm grip until the safety code is entered. Those skilled in the art, in light of the present teachings, will recognize that the safety lever may indicate by feel the firearm remains locked and is set to be unlocked. In some embodiments, when the safety code is entered, a motor may move the safety bar allowing the safety lever to move at least partially into the firearm by hand pressure. In this manner, the safety lever may indicate by feel if the firearm is unlocked.

In one embodiment of the present invention, a safety code portion may allow the firearm to be unlocked through a predetermined code. The safety code portion may accept 3 incorrect code entries then not accept more attempts for 30 minutes. In some embodiments, the processor may actuate a loud alarm to sound 15 to 20 seconds after the firearm is moved.

The assembly may also include, without limitation, a vibration motor to verify successful programming, an accelerometer, and a loud alarm portion for dissuading unauthorized handling. In some embodiments, a tamper resistant portion may help prevent tampering with the safety components of the firearm. An alternative power source may provide backup power. In this manner, trial and error unlocking of the firearm or the defeating of the safety mechanism may be prevented.

In one embodiment of the present invention, the firearm locking assembly may include a multiplicity of modes that provide different accessibility to the firearm. The multiplicity of modes may include, without limitation, an alarm locked mode, a locked travel mode with the accelerometer/alarm off, an unlocked mode with automatic re-locking if the firearm is put down or taken, and a timed unlocked mode with automatic relocking after a programed period of time, to prevent accidently leaving the firearm unlocked for a long period of time. In some embodiments, the locked mode may provide a physical barrier to prevent the firearm from discharging. The locked mode may include a restriction portion that positions with the trigger bar. The trigger may join with and be dependent on a trigger bar to fire the firearm. The restriction portion may include a bar that is configured to restrict movement of the trigger bar. The restriction portion may be internally located in the firearm to engage the trigger bar. In some embodiments, the restriction portion may serve as a physical barrier that restricts the rearward movement of the trigger bar and trigger, and thereby prevents the trigger from discharging the firearm. In some embodiments, a motor may power the restriction portion to and from the trigger bar. In some embodiments, a safety lever may position on the exterior of the firearm. The safety lever may operatively be partially blocked by the restriction portion. The safety lever may be configured to be operable to signal the owner if the restriction portion blocks or allows the trigger assembly to discharge the firearm. The safety lever may be configured to be operable to be depressed by pressure from a hand. In some embodiments, the safety lever may be operatively joined to a processor and act as an electronic switch. The processor may be programmed to actuate the motor to position the restriction portion upon the safety lever being pressed or released as a switch. However, in other embodiments, the processor may be operable to provide numerous other functions for the firearm locking assembly, including, without limitation, communicating with the owner, communicating with the access code portion, communicating that the code must be entered or the alarm will sound because it cannot be fully depressed, communicating via a light or lights associated with the access code portion, communicating with the motor, communicating with the power source and the alternative power source, communicating with the alarm portion, communicating with the GPS, communicating the firearm location to a remote receiver, communicating that a accelerometer indicates the firearm has been fired, communicating with the vibration motor, communicating digital images of what the firearm was pointed at when fired or when the safety lever is pressed, communicating digital images of the party holding the firearm when a false access code is entered. Those skilled in the art, in light of the present teachings, will recognize that the camera feature may help identify if and when an officer is justified in discharging the firearm.

In one embodiment of the present invention, the firearm safety assembly may be operable to automatically regulate functions of a firearm through the use of an accelerometer, a processor, a code entry, and a timer. In some embodiments, the firearm safety assembly may be un-locked by a pushbutton combination lock that prevents unauthorized access to the safety assembly without first entering the correct code. The code may be set very short with 2 or 3 numbers, potentially allowing unauthorized trial end error attempts to unlock the firearm. To mitigate this, the processor may for 30 minutes prevent more than 3 wrong code entries. Moreover to further protect against unauthorized handling the motion detector would alert the processor if the firearm was moved cumulatively over 20 seconds over 30 minutes. When the alarm is triggered, the code must be entered to cancel it.

In one embodiment of the present invention, the keyboard may include three back lit pushbuttons and a green LED light. When firearm is picked up the processor and motion detector cause the green light blink once per second for 15 seconds as a warning that the code must be entered or the alarm will sound if the code is not entered or the firearm put down; then for 5 seconds the light blinks very rapidly as a final warning for 5 seconds. The purpose of the warning blinking lights, motion detector and alarm are not to warn the owner or an unauthorized person that the firearm is unlocked or locked, or signal others the firearm is being handled, but to discourage unauthorized persons such a child, teenager or thief from handling or attempting to unlock the firearm in the first place, without the alarm ever having to sound. The owner is warned by the blinking light that the code must be entered. Those skilled in the art, in light of the present teachings, will recognize that gun owners, such as a police officers, may select an embodiment using only a 2 number code, because the code could be entered very fast, and the risk of an unauthorized person guessing and using the correct code during a takeaway situation is very low.

In some embodiments a police officer or soldier may simply grip the firearm and enter all but the last code number, then put the firearm aside, with the motion detector automatically off and the firearm locked. During the following 12 hours the firearm may be gripped again, partially depressing the safety lever, permitting the remaining code number to be entered to unlock the firearm. If the firearm was wrestled away from the officer or soldier to use it, the advisory would have to first guess if only one number was needed, then guess correctly the first time which of 6 numbers to enter. If the wrong number was entered the alarm would sound. To stop the alarm the grip would have to be released and griped again, then the full 3 number code entered. The advisory risk for a wrong entry would be the silent alarm would send a signal to police headquarters, and or a loud alarm would sound. There is a 83% chance of not randomly guessing one of 6 numbers, less than a 6% chance of randomly guessing a 2 number code and less than a 1% chance of randomly guessing a 3 number code. A military version of the firearm may use more than three pushbuttons and the processor may change the access code every day, so that the firearm is secured until an officer or non commissioned officer releases the access code.

In some embodiments, the assembly may include an unlocked mode that allows the firearm to discharge. The unlocked mode may function to disengage the restriction portion from the trigger bar. In this manner, the trigger may freely move in a rearward direction for discharging the firearm. An access code portion may be operatively joined with the processor for switching between the modes. The access code portion may include a plurality of buttons that may be depressed in combination to switch between modes. In some embodiments, the firearm locking assembly may switch between each mode depending on the manipulation of the access code portion, the processor commands, and pressure exerted on the grip switch. For example, without limitation, depressing the safety lever, that may resemble a grip safety in a convent firearm, then inputting a personal identification number through the multiplicity of buttons, may signal the processor to position the firearm locking assembly into the unlocked mode. The processor may then actuate the motor to position the restriction portion behind the trigger bar in the interior of the firearm, whereby the restriction portion serves as a physical barrier to the rearward movement of the trigger. The external safety lever may then visibly position in proximity to the grip to signal the position of the restriction portion. However, in other embodiments, the additional modes may be utilized. In some embodiments, the timed unlocked mode may unlock the firearm after a predetermined amount of time. The processor and/or the access code portion may trigger the timed unlock mode to position the restriction portion to and from the trigger bar.

In one embodiment of the present invention, the firearm locking assembly may include a firearm. In some embodiments, the firearm locking assembly may be integrated into the firearm. However, in other embodiments, the firearm locking assembly may detachably join the firearm. The firearm may include, without limitation, a hand gun, a pistol, a rifle, a military type assault rifle and a shotgun. The firearm may include a trigger configured to engage a triggering object. The trigger may provide an exterior access for firing the firearm. The trigger may include a trigger bar for operatively joining the trigger with a firing pin in the fire arm. Those skilled in the art, in light of the present teachings, will recognize that an object positioned behind the trigger bar may serve as a physical barrier for preventing the trigger from moving in a rearward direction and discharging the fire arm. In some embodiments, the firearm may include a grip. The grip may be operable to be held by a hand. The grip may include a grip switch. The grip switch may be configured to be operable to be depressed by pressure from a hand. In some embodiments, the grip switch may initiate the functional aspects of the firearm locking assembly by communicating with the processor, actuating an alarm, and operatively joining with the access code portion. The grip may further include an exteriorly positioned safety lever for identifying the position of the restriction portion and the mode of the firearm locking assembly. The safety lever may be positioned by command of the processor to position under the grip switch. The safety lever may include a status portion for indicating the mode of the firearm locking assembly. The safety lever may further include a switch actuator for serving as a switch. An access code portion may be positioned in proximity to the grip and operatively joined with the processor. The access code may include an ergonomically placed keypad having a multiplicity of buttons. The multiplicity of buttons may be depressed in predetermined combinations to communicate with the processor for locking or unlocking the firearm. In some embodiments, manipulating the multiplicity of buttons on the access code portion may provide communication with the processor to switch the firearm locking assembly between each mode.

In one embodiment of the present invention, the firearm locking assembly may include an alarm portion to dissuade an unauthorized person from handling the firearm in the first place, or attempts to guess the correct combination. When the firearm is moved a warning light on the keyboard would blink green once per second for 10, seconds, amber for 6 seconds, then red to dissuade handling. Even if no one was within listening distance to be alerted, the mere prospect of a loud alarm sounding should persuade most unauthorized persons to put the firearm down. The alarm portion may alert with an illumination or an audio signal. However, in one embodiment, the alarm portion may alert inaudibly. In one embodiment, the alarm portion may sound when the safety lever is depressed if the access code portion has not been manipulated in a predetermined amount of time. In some embodiments, the alarm portion may include a motion sensor. The processor may actuate the alarm portion when the motion detector detects movement and the access code portion is not properly manipulated.

In one embodiment of the present invention, the firearm locking assembly may include a tamper resistant portion for preventing forced manipulation of the firearm. The tamper resistant portion may include a motor and a safety rod. The safety rod may be advanced and retracted by a threaded motor shaft to alternatively block and unblock the trigger, while preventing the safety lever from depressing while the firearm is locked. The tamper resistant portion may also serve to restrict access to a power source and an alternative power source in the firearm locking assembly. In one embodiment, the alternative power source may be actuated by the processor when the processor detects removal or low power in the power source, mitigating an objection to firearm battery operated safeties.

In one embodiment of the present invention, the safety lever may engage an internal safety switch when partially depressed. The pressure may actuate a processor to receive a code. The code may signal the processor to unlock the firearm. Pushbuttons may signal the processor to put the assembly into timed unlocked mode, allowing the safety lever to be released for a programmed period of time. When the assembly is in a timed unlock mode, whereby the safety lever may be pressed multiple times to relock the firearm. Those skilled in the art, in light of the present teachings, will recognize the firearm locking assembly may guard against attempts to disconnect the firearm locking assembly. The firearm locking assembly may utilize a 90 decibel alarm that operatively joins with the processor. The firearm locking assembly may further utilize lights associated with the access code portion, a timer and a accelerometer to safeguard against theft, tampering and unauthorized handling by children and others. In some embodiments, firearms intended for hunting may not utilize a motor, restriction portion, or safety lever to prevent the firearm from firing, because they are not used for personal defense; instead they would use the accelerometer to alert the processor of movement requiring the access code be used or the firearm put down within the programmed period of time, and if not the alarm would begin to sound as programmed, making theft or unauthorized handling impractical.

FIG. 1 illustrates a detailed perspective view of an exemplary firearm locking assembly joined with an exemplary firearm in an exemplary locked mode, in accordance with an embodiment of the present invention. In the present invention, the firearm locking assembly may include a plurality of modes operable to restrict use of a firearm. An accelerometer 119 may be configured to detect potential unauthorized handling. In some embodiments, the accelerometer may include, without limitation, a motion detector. A timer associated with the processor 109 may allow a programmed amount of time for the authorizing code to be entered by the use of a plurality of buttons 108 on a rearward facing access code portion 107. The access code portion may include, without limitation, a keyboard blister, a digital display, a switch system, warning lights, image sensors for a digital camera, silent alarm FM and GPS components.

In one embodiment of the present invention, a locked mode may provide a physical barrier to prevent the firearm from discharging. The locked mode may include a restriction portion 102 that positions behind a trigger bar 105. The trigger bar may join with a trigger 106 of the firearm. The restriction portion may include a restriction bar 123 that is configured to restrict movement of the trigger bar. In some embodiments, the restriction portion may be internally located in the firearm to engage the trigger bar. In some embodiments, the restriction portion may serve as a physical barrier that restricts the rearward movement of the trigger, and thereby prevents the trigger from discharging the firearm.

In yet another alternative embodiment, the restriction portion may position behind a firing pin assembly of a firearm to provide a physical barrier, and thereby create the locked mode. In yet another alternative embodiment, the restriction portion may position through a bullet chamber of a firearm to provide a physical barrier, and thereby create the locked mode. In any of the above alternative embodiments, an access code portion 107 and the processor 109 may regulate positioning of the restriction portion for switching between modes. Those skilled in the art, in light of the present teachings will recognize that an eclectic assortment of firearms may utilize the firearm safety assembly to prevent theft. The basic components may vary in size and dimension, but retain their approximate function with various firearms.

In one embodiment of the present invention, the firearm assembly may include a slide 101 containing a barrel, firing pin and firing pin spring. The firearms may further include a grip, a trigger, and a bullet chamber. In one alternative embodiment, the firearm may be enabled by input of a code into rearward facing push buttons. The buttons may be operatively connected to the processor, by circuitry. In this manner, a motor 111 may move the safety bar to unblock the trigger bar hook, consequently allowing the pulling of the trigger.

In one embodiment of the present invention, the motor 111 may power the restriction portion to and from the trigger bar. The motor may include a threaded motor shaft. The motor shaft may operatively join with the threaded end of the restriction portion The threaded portion of the restriction portion, the connector, may orient 90 degrees, so that when the motor is powered, the threaded motor shaft may extend or retract through the threaded aperture in a connector, that inturn extends or retracts the restriction portion, to the locked, unlocked or to the timed unlocked mode. In one embodiment, the restriction portion may be dimensioned and sized approximately 2.5"×0.2"×0.050". However, various other sizes may be utilized depending on the size and style of the firearm. In some embodiments, a safety lever 117 may position on the exterior of the firearm. The safety lever may operatively join with the restriction portion. The safety lever may be configured to be partially pushed in by hand pressure gripping the firearm to contact an internal switch and to be stopped by the restriction portion, to signal to the owner the firearm is locked and ready to receive the access code. In one alternative embodiment, an illumination portion 112 may be used to signify each mode. The illumination portion may include, without limitation, colored lights. Those skilled in the art, in light of the present teachings will recognize that in emergency situations the mode of the firearm may be important to discern by feel and through a quick visual inspection.

In one embodiment of the present invention, a safety lever 117 may position on the grip of the firearm. The safety lever may be configured to act as a switch, be partially pressed in by pressure from a hand, and pushed out by a spring, when released. In some embodiments, the safety lever may be operatively joined to a processor. The processor may be programmed to actuate the motor 111 to position the restriction portion upon pressure on the safety lever allowing the input of the code. For example, without limitation, the safety lever may partially position out from the grip on the exterior of the firearm in the storage, safety engaged mode. When the safety lever is depressed, a spring may compress. The compressed spring may allow the safety lever to position in and be stopped by the restriction portion. The restriction portion may be sloped so that friction caused by excessive squeezing of the safety lever may not prevent the motor from moving the restriction portion to unlock the firearm. The about 0.1" movement of the safety lever may also contact an internal switch signaling the processor to allow the input of a predetermined code. In some embodiments, if an incorrect code is used, the safety lever must be released and repressed, or any button pressed and held in 2+ seconds.

In some embodiments, the restriction portion may be dimensioned and sized approximately 2.2"×0.12"×0.12". However, various other sizes may be utilized depending on the size and style of the firearm. In some embodiments, a safety lever positioned on the exterior of the firearm, in proximity to the grip, may operatively join with the restriction portion. The safety lever may signal the position of the restriction portion inside the firearm, and thereby signal the mode of the firearm locking assembly. In one alternative embodiment, the safety lever's position relative switches connected to the processor may utilize various small lights on the keyboard to signify the present mode or that the correct code has been entered, or that the processor has switched to one or another of the alternate power supply sources. Those skilled in the art, in light of the present teachings, will recognize that in emergency situations the mode of the firearm may be important to discern quickly. In some embodiments, the safety lever may be positioned on the hand grip area of the firearm. The safety lever may be configured to be operable by pressure from a hand, to be stopped on the safety bar, contact a switch to allow input of the owners code so as to unlock the firearm, and thereby allowing further depressing of the safety switch, so that it becomes flush with the grip if held in by hand pressure and signal that the firearm is unlocked. If the safety lever is released it is pushed out by a spring, releasing contact with the switch, signaling the processor to lock the firearm if the firearm is not in timed unlocked mode. In some embodiments, the safety lever may be operatively joined to a processor. The processor may be programmed to actuate the motor to advance the restriction portion and relock the firearm upon being signaled by pressure on the safety lever acting as a switch in the timed unlocked mode, or automatically when the timed unlocked time period expires, including, without limitation after 10 hours.

In one embodiment of the present invention, a grip of a firearm may be operable to be held by a hand. The grip may operatively join with the safety lever. The safety lever may be configured to be operable to be depressed by pressure from a hand. In some embodiments, the safety lever may initiate some of the functional aspects of a conventional grip safety in that when fully depressed the firearm may fire. However, in other embodiments, a conventional grip safety may not be locked when fully extended from the grip and unlike the restriction portion, mechanically prevents the trigger from being pulled, while the safety lever, motor and processor prevent the trigger from being pulled.

In one embodiment of the present invention, the safety lever may be configured to be operable and depressed by pressure from a hand to below the surface of the grip to permit removal of the safety assembly when the gun is unlocked. The safety lever may be operatively joined to a processor. The processor may be programmed to actuate the motor to position the safety bar in response to pressure on the safety lever and the correct code being entered. However, in other embodiments, the processor may be operable to provide numerous other functions for the firearm safety mechanism, including, without limitation, communicating with the safety lever, communicating with the access code portion, communicating with the motion detector, communicating with the vibration motor, communicating with the motor, communicating with the power source and the alternative power source.

In one embodiment of the present invention, the firearm locking assembly may include an alarm portion for alerting to unauthorized use of the firearm. The alarm portion may alert with an illumination or an audio signal. In some embodiments, the alarm portion may include a 90 decibel audio signal. However, in one embodiment, the alarm portion may alert inaudibly. In one embodiment, the alarm portion may alert when the grip switch is depressed if the access code portion has not been manipulated in a predetermined amount of time. The alarm portion may include a accelerometer, including, without limitation one manufactured by Signal Quest or LED lights. The alarm may include, without limitation, a 90+db speaker available from Digikey. In one embodiment, the accelerometer may be sufficiently sensitive to signal to the processor if the firearm is picked up by an unauthorized user. For example, without limitation, after the firearm is moved the alarm portion may blink a warning 20 seconds and if the firearm is not put down or the safety code entered the alarm may sound. However, in other embodiments, different time frames and types of alarms may be utilizes. The power source may include, without limitation, a battery, and a thermal power source. In one embodiment, the power source may be positioned above the processor and adjacent to the motor.

In some embodiments, the firearm locking assembly may include an external power port for docking with an external power source, in the event the power source and the back up power source both fail. However in other embodiments, the firearm locking assembly may include a long lasting power source then switch automatically to an alternative power source and alert the owner by an illuminated light and or alarm that the power source needed replacing.

Figure 2:
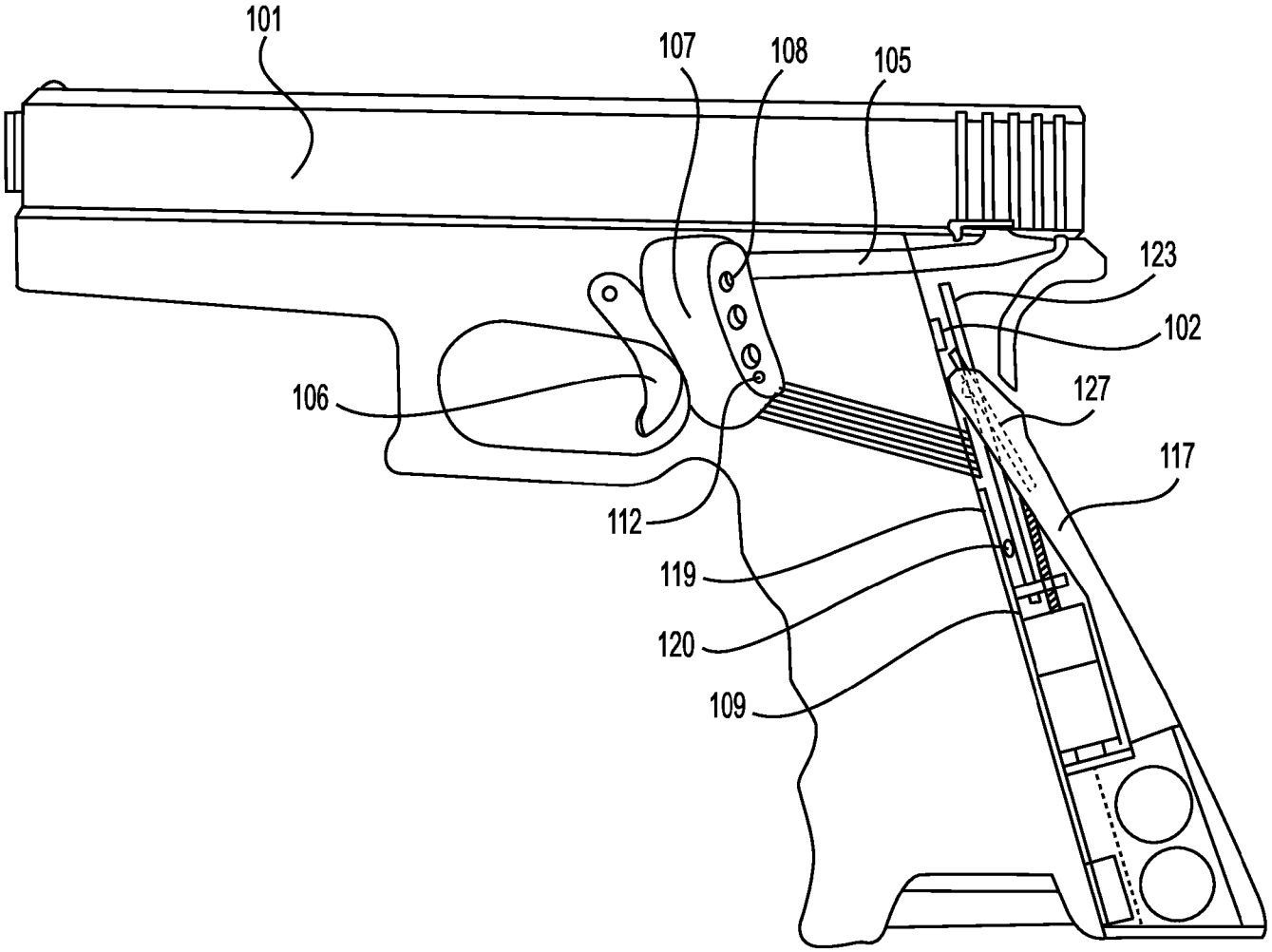
FIG. 2 illustrates a detailed perspective view of an exemplary firearm locking assembly joined with an exemplary firearm in an exemplary unlocked mode, in accordance with an embodiment of the present invention.

FIG. 2 illustrates a detailed perspective view of an exemplary firearm locking assembly joined with an exemplary firearm in an exemplary unlocked mode, in accordance with an embodiment of the present invention. In the present embodiment, the firearm locking assembly may include an unlocked mode that allows the firearm to discharge. The unlocked mode may function to disengage the restriction portion from the trigger bar. In this manner, the trigger may freely move in a rearward direction for discharging the firearm. An access code portion 107 may be operatively joined with the processor 109 for switching between the modes. The access code portion may include a plurality of buttons 108 that may be depressed in combination to switch between modes. Those skilled in the art, in light of the present teachings will recognize that myriad combinations of button manipulation may be utilized for any function of the firearm locking assembly. In one embodiment, the multiplicity of buttons may include 2 to 5 buttons in a row on a keypad measuring approximately 1"×0.3" to 0.5". Those skilled in the art, in light of the present teachings will recognize that a 3 button keypad would be the equivalent of 6 buttons if the processor is programmed to interpret the pressing of 2 buttons at once as additional numbers and programmed to interpret an approximate 1 second press of the 6 equivalent buttons as 6 more equivalent numbers. For example, without limitation, 3 buttons may be positioned close together in a row to allow the user's thumb to press 2 buttons at once. In this embodiment buttons 1 and 2 pressed at once may be the equivalent of button 4, but if pressed a little longer, about 1 second, may be the equivalent of button 8. In some embodiments, a 3 button keyboard would have the equivalent of 12 buttons and pressed only once may allow 12 possible codes, pressed twice 144 possible codes and 3 times 1728 possible codes. In yet another embodiment, an owner may choose a 1 number code with the alarm to sound if a wrong code is entered. In some embodiments, an owner may select a 2 number code with 144 possible combinations with the alarm to sound if a second wrong attempt is made to unlock the gun. For home defense, a 3 number code may be preferred if used in conjunction with pre entering the first 1 or 2 code numbers. An unauthorized person would not know if 1, 2 or 3 presses were required, or if 1 press of a button or one press of the safety lever would cause the alarm to sound. A police officer used to using a conventional thumb safety with 1 push, might use the 1 push safety method of the instant invention.

In one embodiment of the present invention, the access code portion and the plurality of buttons 108 positioned on a keyboard may be ergonomically oriented and aligned, to be seen by the owner when aiming the firearm and include outer buttons and adjacently positioned backlit buttons on a keypad. The multiplicity of buttons may be positioned in proximity to the grip and configured to be operable, such that a thumb may press either outer buttons, or either outer buttons and the adjacent button simultaneously. In some embodiments, the firearm locking assembly may switch between each mode depending on the manipulation of the access code portion, the processor commands, and pressure exerted on the safety switch. For example, without limitation, depressing the safety switch and inputting a personal identification number through the multiplicity of buttons may signal the processor to position the firearm locking assembly into the unlocked mode. The processor may then actuate the motor to position the restriction portion behind the trigger bar in the interior of the firearm, whereby the restriction portion may serve as a physical barrier to the rearward movement of the trigger.

Figure 3:
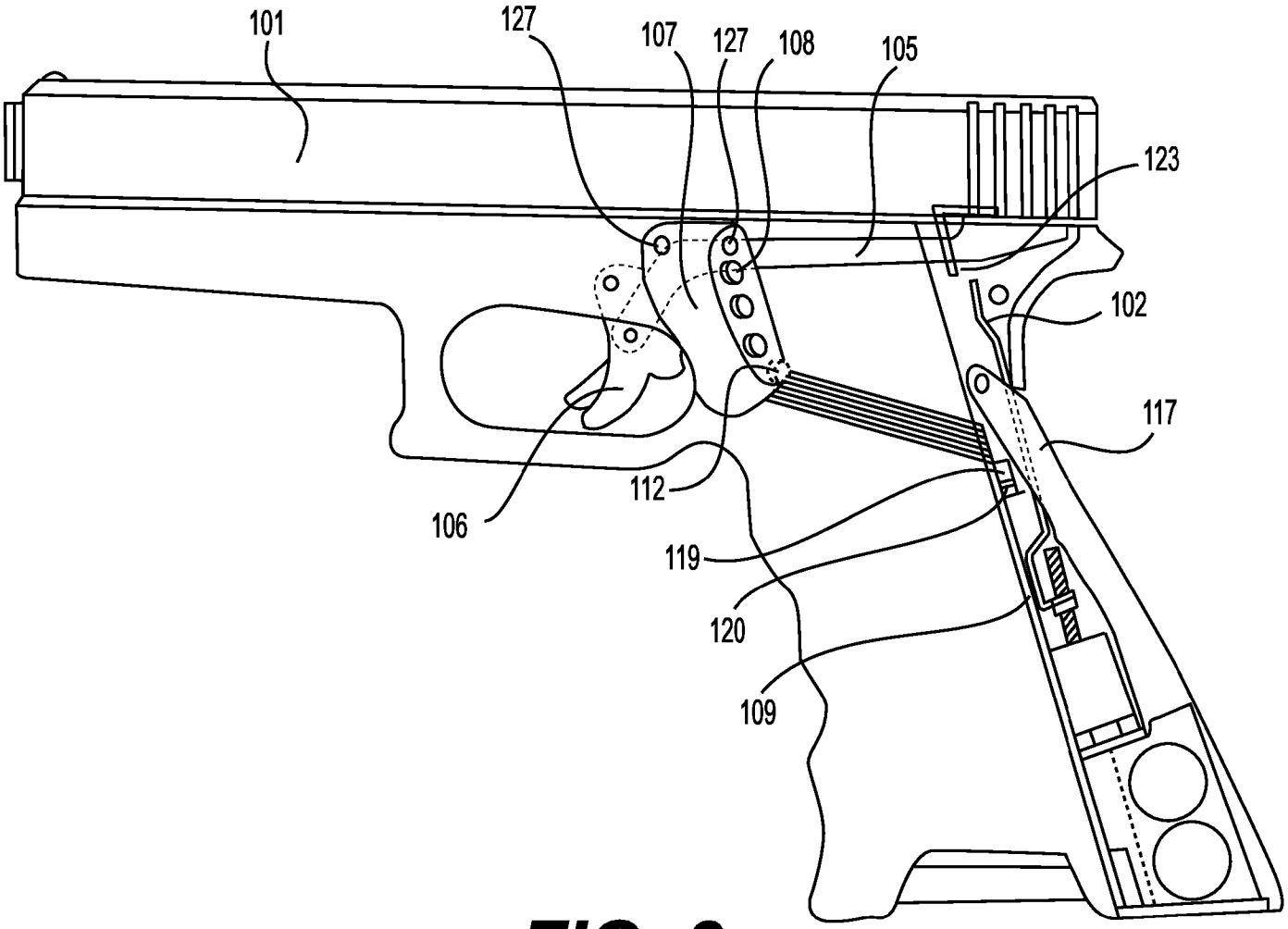
FIG. 3 illustrates a detailed perspective view of an exemplary firearm locking assembly joined with an exemplary firearm in an exemplary unlocked or timed unlocked mode in accordance with an embodiment of the present invention.

FIG. 3 illustrates a detailed perspective view of an exemplary firearm locking assembly joined with an exemplary firearm in an exemplary timed unlocked mode, in accordance with an embodiment of the present invention. In the present embodiment, the timed unlocked mode may provide an additional security feature whereby the firearm locking assembly switches from the unlocked mode to the locked mode after a predetermined amount of time, such as 10 hours. The time frame may be dependent on numerous factors, including, without limitation, the entry of an access code through the multiplicity of buttons, the processor, and the discharge of the firearm. In some embodiments, the timed unlocked mode may lock or unlock the firearm after a predetermined amount of time. An accelerometer 119 may be operable to alert the processor of potential unauthorized movement. In some embodiments, if the code is not entered within the programmed period of time the processor may cause the alarm portion 120 to emit a loud alarm and or a silent alarm.

In one embodiment of the present invention, the firearm safety assembly may include special law enforcement personnel modes. The law enforcement personnel modes may be operable to prevent a criminal from forcibly obtaining the firearm from law enforcement personnel. The law enforcement personnel modes may be used for civilian use as well, and may include, without limitation:

A Sleep Mode Gun locked, motion detector and alarm on; and

An instant alarm mode where all but final code number may be entered, and the gun waits for the final number to be entered with the motion detector off. Once the gun is gripped and the correct final number is entered, the gun immediately unlocks. If the wrong number is entered or if the safety lever is pressed a little and released, the alarm sounds requiring that the full code be entered to unlock the gun.

The gun uses a 3 or 4 number press code to unlock the gun. When the owner knows they made a code entry mistake they may release and re-press the safety lever in, or hold any button in 3+ seconds, until the gun vibrates, then enter their code again. If their 2ed attempt is wrong, they may try again but a wrong 3ed attempt will cause the alarm to sound unless the 20 seconds has expired and the alarm already is sounding. When the gun is locked the owner may pre-enter all but the last 1 or 2 numbers of the code, within 20 seconds of picking up the gun, then put the gun down. The gun remembers the entry and will accept the last 1 or 2 code numbers. If the owner or an unauthorized person picks up the gun partially depressing the safety lever, the alarm will sound. Instead of trying a 3rd time, they could put the gun down for 30 minutes and then start over, or enter the full correct 3 or 4 number press code. If their 3ed entry is wrong, the gun assumes they are not the owner, blocks all entry attempts for 30 minutes, and requires the full code be entered.

There are two safeties in Sleep Mode. First, the trigger is locked and the gun cannot be fired without a simple code being entered which retracts the safety bar, allowing the trigger to be pulled. If the grip safety lever is released the gun automatically relocks. The second safety works if the motion detector detects any firearm movement. If the owner, a child, thief or other unauthorized person picks up the gun a warning green light blinks once per second for 10 seconds then amber twice per second for 6 seconds, then red for 4 seconds, unless the firearm is put down or the code entered; otherwise, a loud alarm may sound and can't be stopped until the owner enters their code.

If movement stops or the code is entered before 20 seconds expires, the alarm countdown is halted, but resumes with further movement within 30 minutes of initial movement if the code has not been entered. If movement stops with less than 5 seconds, the time would be reset to 5 seconds, but only once. When the code is entered the safety lever is allowed to go in by hand pressure to confirm the firearm has been unlocked; the keyboard light stops blinking and the firearm vibrates 1 second, all three signaling that the gun is unlocked. With the safety lever held in and the gun is unlocked; and the owner has several choices:

1) continue to hold the unlocked gun, 2) put the gun down releasing pressure on the safety lever, automatically relocking the gun, 3) press button #3-3 seconds to unlock firearm 12 hours, 4) press button #2-3 seconds to turn off motion detector/alarm feature, until button #2 is pressed again for 3 seconds, 4) press button #1-3 seconds to turn motion detector/alarm feature off for 12 hours, then release the safety lever, 5) press button #1 twice to add 2 hours to 12 hour timed unlocked, 6) press button #2 twice to subtract 2 hours from 12 hour timed unlocked, 7) in timed unlocked return to unlocked or locked mode by pressing safety lever 3 times within 5 seconds. If last press is held in, firearm is in unlocked mode and will return to locked mode when safety lever is released, 9) while the gun is in timed unlocked mode and the safety lever is out, rapidly press and release the safety lever 3 times, which relocks the gun, or hold button #3 in for 3 seconds; the gun relocks after it vibrates and both button #3 and the safety lever are released, 10) press safety lever or button #3-4 times within 5 seconds and the audible alarm will sound, (any mode)

12) press button #2 in-4 times and the silent alarm will sounds, (any mode)

13) press button #-3 in and both the silent and audible alarm to sounds, (any mode)

Figure 4:
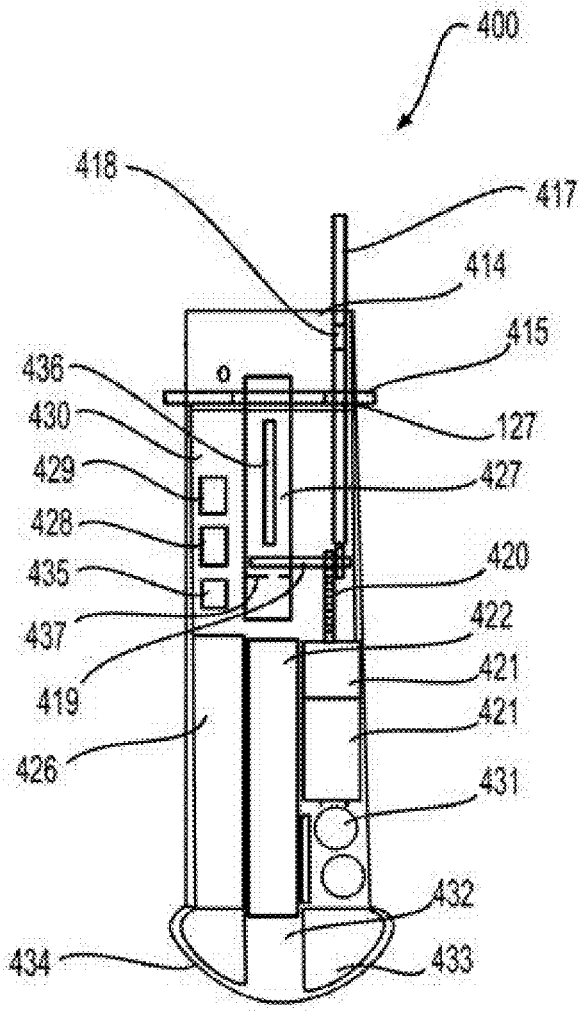
FIG. 4 illustrates a plan view of an exemplary safety assembly of a firearm, in accordance with an embodiment of the present invention.
Figure 6:
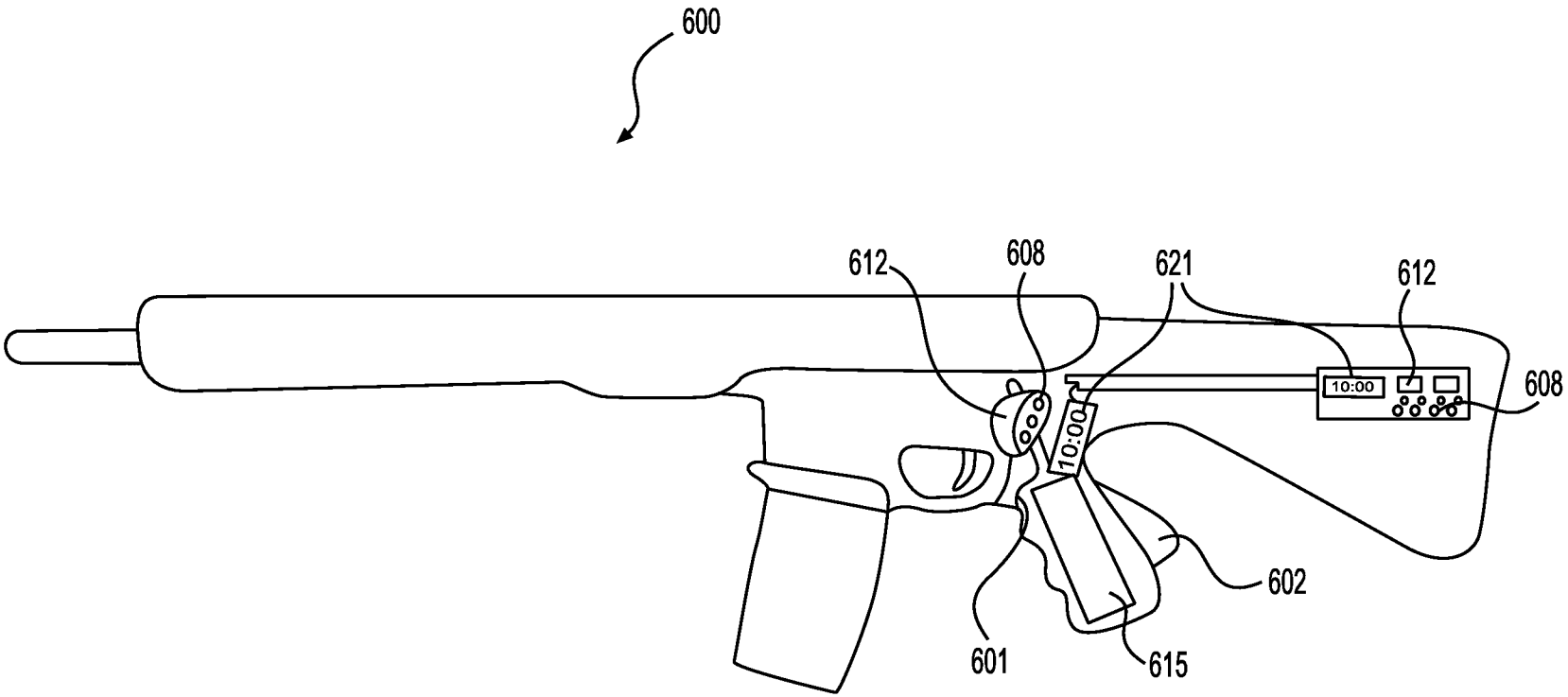
FIG. 6 illustrates a detailed perspective view of an exemplary firearm locking assembly joined with an exemplary military type long firearm, in accordance with an embodiment of the present invention.

FIG. 4 illustrates a plan view of an exemplary safety assembly of a firearm, in accordance with an embodiment of the present invention. In the present embodiment, the safety assembly 400 may be integrated into the firearm behind a magazine compartment in the grip. However, in other embodiments, the safety assembly may detachably join the firearm in a recess, be affixed to the side of the firearm's stock, in the firearm's grip in a hand gun or assault rifle or elsewhere. In an assault weapon the safety assembly may be located in the grip or in the stock as depicted in FIG. 6. In some embodiments, the safety assembly may retrofit an existing firearm, including assault weapons with a safety assembly locked against tampering, using a processor 430, access code portion, timer with time remaining readout 621, motion detector 429 and alarm 428 without a blocking bar 417. In one embodiment, the safety assembly may include a carriage 414, a carriage lock 127 that prevents the carriage from being pulled past the safety lever pin 415, unless the cut 127 in the safety lever pin 415 is rotated to face down, which cannot occur unless the blocking bar 417 has been retracted so its slot 418 aligns with the cut 127 in the safety lever pin 415, a removable battery module with 2 AAAA batteries provides power 422, a backup battery module also with 2 AAAA batteries 426, for security requires the unlocking and removal of carriage to access the batteries. It should be understood an alternate power source than AAAA batteries may be used. The processor automatically will switch to the backup batteries when needed and alert the owner when the owner picks up the firearm that the primary batteries need replacing, by having the warning light blink amber instead of green. A motor 421, and gear box 421' turn the motor's threaded shaft 420 to advance or retract the connector 419 and the blocking bar 417. The safety assembly's detachable carriage 414 contains the processor's board 430 that contains a silent alarm, FM radio transmitter/components 428, GPS 435, digital camera components and the motor. The vibration motor is located at 431. If the safety lever 427 can be pushed in to overcome the spring 436, it indicates the firearm is unlocked and be fired; if instead it cannot be pushed in it indicates the firearm is locked and requires the code be entered to operate the firearm. In timed unlocked mode the accelerometer 429, the alarm 428, the safety lever pin 415 with notch 416 cannot be removed while the safety bar notch 418 is forward. In one embodiment forward and rearward facing camera arrays 127, FIG. 3 may be located in the 107 access code portion. A slot 432 in the angled butt portion 433 of the carriage 414 permits the removal of the battery module 422, after removal of the butt cover 434.

In one embodiment, the grip may include a trigger configured to engage a triggering object. The trigger may provide an exterior access for firing the firearm. The trigger may include a trigger bar for operatively joining the trigger with a firing pin in the firearm. Those skilled in the art, in light of the present teachings, will recognize that an object positioned behind the trigger bar may serve as a physical barrier for preventing the trigger from moving in a rearward direction and discharging the fire arm. In some embodiments, the firearm may include a grip.

In one embodiment of the present invention, the grip may be operable to be held by a hand. The grip may include the safety lever. The safety lever 427 may be configured to be operable to be depressed a little by pressure from a hand, to be stopped by the connector that connects the threaded motor shaft and the safety bar 419. When the motor retracts the connector, hand pressure on the safety lever causes the safety lever to drop down about ¼" to become flush with the grip, when it comes to the safety lever shear at 437. This signals the owner that the firearm unlocked. In some embodiments, the safety lever may initiate the functional aspects of the firearm locking assembly by communicating with the processor, actuating an alarm, and operatively joining with the access code portion. The grip may further include an exteriorly positioned safety lever for identifying the position of the restriction portion and the mode of the firearm locking assembly. The safety lever may serve as a status portion for signaling the mode of the firearm locking assembly. The safety lever may serve as a switch. In some embodiments, an access code portion may be positioned in proximity to the grip and operatively joined with the processor. The access code may include an ergonomically placed keypad having a multiplicity of buttons. The multiplicity of buttons may be depressed in predetermined combinations to communicate with the processor for locking or unlocking the firearm. In some embodiments, manipulating the multiplicity of buttons on the access code portion may provide communication with the processor to switch the firearm locking assembly between each mode. In some embodiments, the safety lever may be configured to operate as a switch to be depressed by pressure from a hand about 0.1" and contact a switch connected to the processor in order to permit entering a code. The code portion may include, without limitation, the ability to identify a personal identification number, a password, and a fingerprint reader. In some embodiments when the safety lever is released, a spring may push the safety lever out to a switch which signals the processor that the motor is to advance the restrictive portion to lock the firearm, then put the safety mechanism in sleep mode.

Figure 5:
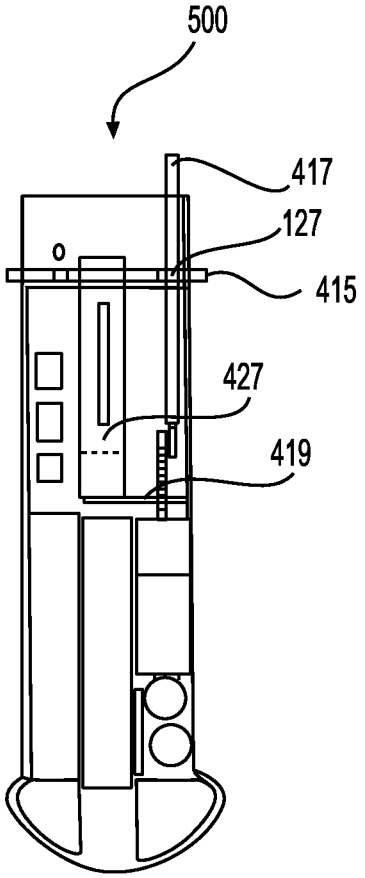
FIG. 5 illustrates a plan view of the exemplary safety assembly of FIG. 4, but with the blocking element retracted in the unlocked position.

In one embodiment of the present invention, the safety lever may identify the position of the safety bar, the mode of the firearm locking assembly, and when released, may be pushed out from the grip by a spring. This may indicate to the processor to advance the safety bar and lock the gun automatically. The safety lever may include a conventional grip safety that mechanically prevents the trigger from being pulled. The safety lever may communicate with the processor to have the motor advance the safety bar to block the trigger bar and trigger. The safety lever may hinge off the trigger mechanism housing pin. In one embodiment, the safety lever and a grip are unitary. The trigger mechanism housing pin may include a slot 127 that prevents the pin's removal unless the firearm is unlocked with the safety bar retracted as can be seen at FIG. 5. In this manner, the pin may restrict access to the safety mechanism and potential tampering.

The safety lever may serve as a relocking switch, if the firearm is put down or taken away it goes out, relocking the firearm. In some embodiments, if the firearm is put down in the Timed Unlocked Mode, the safety lever may go fully out, but may be fully depressed to signal that the firearm is in timed unlocked mode. In some embodiments if the safety lever is released in Timed Unlocked Mode it may extend outwardly to restrict the firearm from re-locking. In a holster an owner simply would push the safety lever down to assure themselves if the firearm was in timed unlocked mode or locked. Someone considering a take away would not know in advance if the firearm was locked or unlocked, giving some protection to an officer who prefers to carry their firearm in timed unlocked mode.

In one embodiment of the present invention, the processor may be operable to provide numerous other functions for the firearm locking assembly, including, without limitation, communicating with the safety lever, communicating with push buttons, communicating with warning lights, communicating with the access code portion, communicating with the motor, communicating with the power source and the alternative power source, communicating with the motion detector/accelerometer, communicating with the audible alarm, communicating with the silent alarm, communicating with a GPS, communicating with digital image recording component communicating with the vibration motor, communicating with an internal FM transmitter, communicating with a law enforcement agency, communicating with a private security company, communicating with the keyboard, communicating with small status lights in the keyboard, communicating with the firearm owner that the power source, which may be a battery is weak, and that it should be replaced when convenient, and that the processor has automatically switched to one of the alternative power sources. For example, without limitation, upon sensing pressure from the grip switch and receiving a predetermined personal code from the access code portion, the alarm portion may relay to the processor to actuate the motor for positioning the restriction portion into the locked, unlocked or timed unlocked mode. In some embodiments, the unlocked modes. The processor may further utilize the power source. The power source may include, without limitation, a 3.6 volt Tadiran battery, or 2-1.5 volt AAAA batteries. The alternative power source may include, without limitation, a backup 3.6 volt Tadiran battery, and or 2-AAAA batteries. In some embodiments, the processor may further utilize either the power source or the alternative power source to power the motor. In one alternative embodiment, the processor may record and transmit all activity of the firearm locking assembly to a remote processor. In some embodiments, the firearm locking assembly may include an external power port for docking with an external power source in the event of battery failure. In one embodiment of the present invention, the firearm may include a vibrating motor. The vibrating motor may vibrate to indicate various signals, including, without limitation, when the authorized user successfully unlocks or commands the firearm, warn a child or owner to put the firearm down, or other status of the mechanism. In some embodiments, the vibration motor may be located in the butt area of the firearm, forward and rearward facing digital camera image sensors may be located in the keyboard blister.

In one embodiment, the alarm portion may include a motion detector, illumination, and an audio signal, whereby the illumination may illuminate if the firearm is picked up and the personal identification number is not entered. In yet another embodiment, if the firearm is not put down, the audio signal may emit audio if handled by an unauthorized user. In one embodiment of the present invention, the alarm portion may include an accelerometer. The accelerometer may include, without limitation, a motion sensor. The motion sensor may actuate the alarm portion when the firearm is engaged and the access code portion is not properly manipulated. In one embodiment, the motion sensor may be sensitive enough to signal to the processor if the firearm is picked up by an unauthorized user. The unauthorized user may include, without limitation, a child, a teenager, and a burglar. For example, without limitation, after 5 seconds, warning light may begin to flash, and if a personal identification number is not entered into the access code portion, the alarm may commence after 10 more seconds and the firearm may remain in the locked mode with the alarm sounding every 3 minutes after first half hour until the power source depletes. The alternative power source may commence generating power when the personal identification number is entered, or when the processor communicates to the alternative power source. The power source may include, without limitation, a battery, and a thermal power source. In one embodiment, the power source may be positioned below and adjacent to the motor.

In one embodiment of the present invention, the firearm locking assembly may include a tamper resistant portion for preventing forced manipulation of the firearm. In one embodiment, the interior of the firearm and the firearm locking assembly may not be accessed without first entering a personal identification number into the access code portion, whereby the processor unlocks the firearm locking assembly and provides access to the interior of the firearm. In some embodiments, the tamper resistant portion may utilize the motor and the safety rod. The safety rod may join with a motor shaft to prevent the grip switch from depressing. The tamper resistant portion may also serve to restrict access to a power source and an alternative power source in the firearm locking assembly. In one embodiment, the alternative power source may be actuated by the processor when the processor detects removal or low power in the power source FIG. 5 illustrates a detailed plan view of the firearm locking assembly of FIG. 4, but with the safety bar 417 (102—FIG. 2) retracted so as to allow the trigger bar 105 and trigger 106 to be pulled to discharge the firearm, as can be seen. The firearm is unlocked, the slot in the safety bar aligns with safety lever pin 415 at 127, which would allow the pin to be removed if desired.

FIG. 6 illustrates a detailed perspective view of an exemplary firearm locking assembly joined with an exemplary military assault firearm or long firearm, in accordance with an embodiment of the present invention. A military assault type firearm 600 may utilize the safety assembly 615 joined as part of the body of the firearm or as part of the grip. The grip itself may contain a version of the safety assembly depicted at FIGS. 4 and 5 and be selectively detachable at 601. The safety lever 602 when out signals the firearm is locked, and when it can be pushed all in signals the firearm is in timed unlocked mode. A visual time remaining read out 621 signals time remaining until silent or audio alarm sounds. Authorizing code is input by pushbuttons 608. Motion detector 60*g* causes a silent or audio alarm to sound. When detached the firearm could not be properly held and the firing mechanism would automatically be locked without the grip being attached. The grip could not be removed unless the correct code was entered. In a military storage situation in a foreign country with insurgents, the grips could be secured separately. The weapons could be issued to foreign troops but with the grips issued when going into combat. Non-functioning training grips could be used but the gun could not be fired. If the safety assembly was detachable and could be inserted into the grip or if the grip was detachable there would be the benefit to military command of controlling the ability of the firearm to work. The processor in each safety assembly could automatically change the access code every 24 hours in each weapon. An army squad etc. could use a separate code given out each day. Each gun would have a separate serial number. The first or last number of the serial could be used to unlock the weapon when combined with the code issued for the day. Thus each weapon could have its unique code, that if somehow the firearm was lost, it would become useless to the enemy 12 or 24 hours after it was unlocked. The safety assembly has a GPS and silent alarm/FM transmitter. If the enemy obtained a firearm not only would it not work, but the safety assembly could broadcast its location. In the present embodiment, the firearm may include, without limitation, a handgun, a pistol, a revolver, a rifle, a shotgun, and military type or appearing hand held firearms. The basic components of the firearm locking assembly may be utilized with many devices designed to discharge projectiles. In some embodiments, the unique configuration and shape of the firearm such as a pistol may create a visible identification that the firearm is protected against unauthorized handling. In some embodiments, the safety assembly may include a motor 421. The safety assembly may further include batteries within battery packs 422, 426, which may include, without limitation, a processor that automatically implements a spare battery pack or batteries and or a solenoid. An assault rifle may have more battery room needed for a solenoid. The assault type long firearm may include, without limitation, a processor including a time remaining display 621, push buttons 608, status lights 612, an accelerometer, an alarm, trigger 606, a safety lever 602, a barrel 601 and a power source 615.

In some embodiments, the military or long firearm may not use a motor 421, a restriction portion 417, and a safety lever 427. The motor may advance or retract the restriction portion 417 to prevent firing of the firearm. The plurality of buttons on the access code portion may enable inputting the enabling code and programing the number of hours the firearm is to be in its timed unlocked mode, which would be displayed. In one embodiment, the safety lever 427 may not be used in favor of using a time remaining readout 421.

In a military assault type firearm the processor may require a new entry code be entered every day, associated with the serial number or as provided by the military. Thus the military could retain control of firearms supplied to its or foreign troops beyond one day.

In one alternative embodiment, the processor may be programmed to switch between modes during various times in a 24 hour period. For example, without limitation, the firearm locking assembly may switch to unlocked mode during working hours in the day, and then switch to locked mode during the night. Those skilled in the art, in light of the present teachings, will recognize that firearms used for hunting such as rifles and shotguns may include automatic relocking by releasing the restriction portion. The restriction portion, however, may be replaced with the processor timing programing automatically implementing the safety mode including the motion detector, alarm portion, and locking the trigger.

Figure 7:
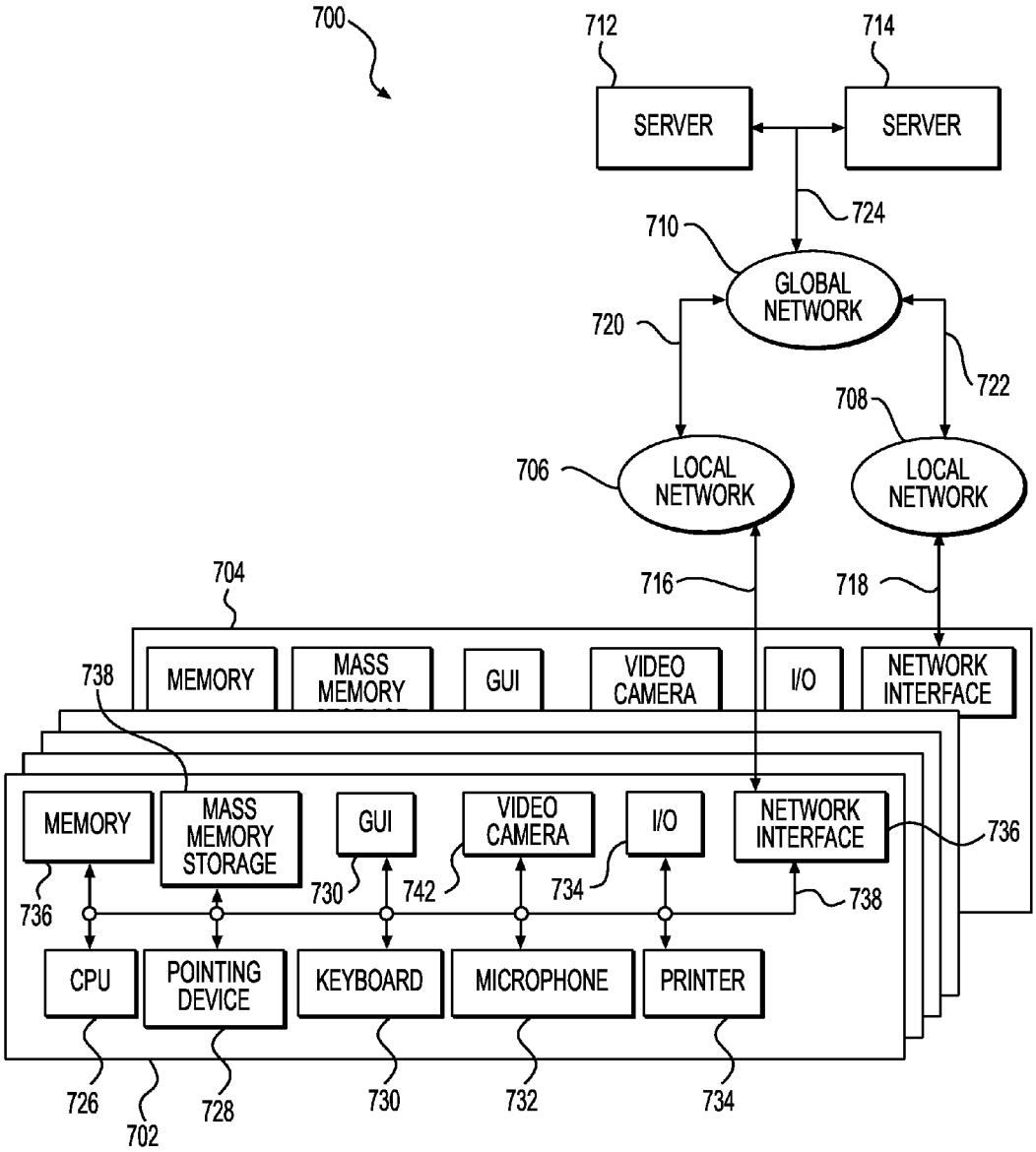
FIG. 7 illustrates a typical computer system that, when appropriately configured or designed, may function in an exemplary firearm locking assembly, in accordance with an embodiment of the present invention.

FIG. 7 is a block diagram depicting an exemplary client/server system which may be used by an exemplary web-enabled/networked embodiment of the present invention.

A communication system 700 includes a multiplicity of clients with a sampling of clients denoted as a client 702 and a client 704, a multiplicity of local networks with a sampling of networks denoted as a local network 706 and a local network 708, a global network 710 and a multiplicity of servers with a sampling of servers denoted as a server 712 and a server 714.

Client 702 may communicate bi-directionally with local network 706 via a communication channel 716. Client 704 may communicate bi-directionally with local network 708 via a communication channel 718. Local network 706 may communicate bi-directionally with global network 710 via a communication channel 720. Local network 708 may communicate bi-directionally with global network 710 via a communication channel 722. Global network 710 may communicate bi-directionally with server 712 and server 714 via a communication channel 724. Server 712 and server 714 may communicate bi-directionally with each other via communication channel 724. Furthermore, clients 702, 704, local networks 706, 708, global network 710 and servers 712, 714 may each communicate bi-directionally with each other.

In one embodiment, global network 710 may operate as the Internet. It will be understood by those skilled in the art that communication system 700 may take many different forms. Non-limiting examples of forms for communication system 700 include local area networks (LANs), wide area networks (WANs), wired telephone networks, wireless networks, or any other network supporting data communication between respective entities.

Clients 702 and 704 may take many different forms. Non-limiting examples of clients 702 and 704 include personal computers, personal digital assistants (PDAs), cellular phones and smartphones.

Client 702 includes a CPU 726, a pointing device 728, a keyboard 730, a microphone 732, a printer 734, a memory 736, a mass memory storage 738, a GUI 740, a video camera 742, an input/output interface 744 and a network interface 746.

CPU 726, pointing device 728, keyboard 730, microphone 732, printer 734, memory 736, mass memory storage 738, GUI 740, video camera 742, input/output interface 744 and network interface 746 may communicate in a unidirectional manner or a bi-directional manner with each other via a communication channel 748. Communication channel 748 may be configured as a single communication channel or a multiplicity of communication channels.

CPU 726 may be comprised of a single processor or multiple processors. CPU 726 may be of various types including micro-controllers (e.g., with embedded RAM/ROM) and microprocessors such as programmable devices (e.g., RISC or SISC based, or CPLDs and FPGAs) and devices not capable of being programmed such as gate array ASICs (Application Specific Integrated Circuits) or general purpose microprocessors.

As is well known in the art, memory 736 is used typically to transfer data and instructions to CPU 726 in a bi-directional manner. Memory 736, as discussed previously, may include any suitable computer-readable media, intended for data storage, such as those described above excluding any wired or wireless transmissions unless specifically noted. Mass memory storage 738 may also be coupled bi-directionally to CPU 726 and provides additional data storage capacity and may include any of the computer-readable media described above. Mass memory storage 738 may be used to store programs, data and the like and is typically a secondary storage medium such as a hard disk. It will be appreciated that the information retained within mass memory storage 738, may, in appropriate cases, be incorporated in standard fashion as part of memory 736 as virtual memory.

CPU 726 may be coupled to GUI 740. GUI 740 enables a user to view the operation of computer operating system and software. CPU 726 may be coupled to pointing device 728. Non-limiting examples of pointing device 728 include computer mouse, trackball and touchpad. Pointing device 728 enables a user with the capability to maneuver a computer cursor about the viewing area of GUI 740 and select areas or features in the viewing area of GUI 740. CPU 726 may be coupled to keyboard 730. Keyboard 730 enables a user with the capability to input alphanumeric textual information to CPU 726. CPU 726 may be coupled to microphone 732. Microphone 732 enables audio produced by a user to be recorded, processed and communicated by CPU 726. CPU 726 may be connected to printer 734. Printer 734 enables a user with the capability to print information to a sheet of paper. CPU 726 may be connected to video camera 742. Video camera 742 enables video produced or captured by user to be recorded, processed and communicated by CPU 726.

CPU 726 may also be coupled to input/output interface 744 that connects to one or more input/output devices such as such as CD-ROM, video monitors, track balls, mice, keyboards, microphones, touch-sensitive displays, transducer card readers, magnetic or paper tape readers, tablets, styluses, voice or handwriting recognizers, or other well-known input devices such as, of course, other computers.

Finally, CPU 726 optionally may be coupled to network interface 746 which enables communication with an external device such as a database or a computer or telecommunications or internet network using an external connection shown generally as communication channel 716, which may be implemented as a hardwired or wireless communications link using suitable conventional technologies. With such a connection, CPU 726 might receive information from the network, or might output information to a network in the course of performing the method steps described in the teachings of the present invention.

Those skilled in the art will readily recognize, in light of and in accordance with the teachings of the present invention, that any of the foregoing steps and/or system modules may be suitably replaced, reordered, removed and additional steps and/or system modules may be inserted depending upon the needs of the particular application, and that the systems of the foregoing embodiments may be implemented using any of a wide variety of suitable processes and system modules, and is not limited to any particular computer hardware, software, middleware, firmware, microcode and the like. For any method steps described in the present application that can be carried out on a computing machine, a typical computer system can, when appropriately configured or designed, serve as a computer system in which those aspects of the invention may be embodied.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods of implementing firearm locks that operate by command of a processor and an access code, and include an alarm to warn against unauthorized users according to the present invention will be apparent to those skilled in the art. Various aspects of the invention have been described above by way of illustration, and the specific embodiments disclosed are not intended to limit the invention to the particular forms disclosed. The particular implementation of the firearm locks that operate by command of a processor and an access code, and include an alarm to warn against unauthorized users may vary depending upon the particular context or application. By way of example, and not limitation, the firearm locks that operate by command of a processor and an access code, and include an alarm to warn against unauthorized users described in the foregoing were principally directed to locking firearms against unauthorized users implementations; however, similar techniques may instead be applied to tools in a scientific laboratory or construction site, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. An assembly comprising:

a firearm, said firearm having an interior within at least one of a grip and a stock, said firearm including a trigger assembly having a trigger or a trigger together with a trigger bar, said trigger assembly being configured to be operable to actuate said firearm to discharge a projectile;

a safety assembly on the firearm and being configured to restrict access to said firearm, said safety assembly comprising an access code portion configured to regulate access to said safety assembly, wherein said access code portion comprises a plurality of push buttons operable to generate an access code to operate the safety assembly, said safety assembly further comprising a carriage within the interior of the at least one of a grip and a stock of said firearm including:

a processor operable to provide timing and code access programming for regulating said safety assembly;

an alarm portion being operable to emit an audible alarm from the locking assembly;

an accelerometer configured to detect motion of said firearm, wherein said accelerometer being operable to emit a signal to said processor such that said processor can actuate the alarm portion after a predetermined time of detected motion to emit the audible alarm;

a restriction portion movable within the interior; and a motor configured to advance said restriction portion to a locked position such that the restriction portion serves as a physical barrier to restrict movement of the trigger assembly so as to prevent said trigger from being pulled, said locked position of the restriction portion further locking the carriage such that the carriage is locked within the interior, wherein said motor is further operable to retract said restriction portion to remove said physical barrier preventing said trigger from being pulled and unlock the carriage of the safety assembly to enable removal of said carriage from the interior.

2. The safety assembly of claim 1, in which said safety assembly further comprising a safety lever, said safety lever being configured to be operable to be pressed by a hand, said safety lever further being configured to be blocked by said restriction portion such that said safety lever can not be fully depressed into said grip but said safety lever can be partially depressed; said safety lever being operable to emit a signal to said processor through a switch when said safety lever is partially depressed wherein said safety lever and the carriage cannot be removed from the interior of the grip without said motor retracting said restriction portion that prevents said trigger from being pulled and prevents said safety lever being fully depressed into said grip.

3. The assembly of claim 1, wherein a vibration motor is operable to vibrate said firearm to signal a change of modes from locked to unlocked.

4. The assembly of claim 2, wherein said safety lever is configured to be operable to be depressed by a hand, said safety lever further configured to communicate a position of said restriction portion.

5. The assembly of claim 1, wherein said access code portion is operable to switch between a plurality of modes, said plurality of modes being operable to regulate said assembly, said plurality of modes comprising an unlocked mode, said safety lever being configured to signal that said firearm is unlocked if said safety lever can be held in, said plurality of modes further comprising a timed unlocked mode, said timed unlocked mode being configured so that said firearm remains unlocked for a programmed period of time, wherein afterwards the processor automatically relocks the firearm, said plurality of modes further comprising a sleep mode, said sleep mode being configured so that said accelerometer and said alarm portion are engaged and said locking assembly is engaged, said plurality of modes further comprising a travel mode, said travel mode being configured so that said locking assembly is in said locked position but with said accelerometer off, said plurality of modes further comprising an abbreviated code mode, said abbreviated code mode being configured so that said processor is programmed to unlock the firearm with at least one access code press.

6. The timed unlocked mode of claim 5, wherein said timed unlocked mode is operable to stop functioning upon reception of a signal.

7. The assembly of claim 6, wherein said timed unlocked mode is operable for said accelerometer to power off.

8. The assembly of claim 5, wherein said timed unlocked mode is configured so that a programmed number of presses on said safety lever locks said firearm.

9. The assembly of claim 8, wherein said timed unlocked mode is configured so said travel mode is operable to receive an access code from said access code portion.

10. The assembly of claim 1, in which said access portion comprises an illuminated portion, said illuminated portion being operable to signal safety assembly status.

11. The assembly of claim 1, wherein said alarm portion is operable to emit a non-audible signal to a remote receiver or receivers.

12. The safety assembly of claim 1, wherein said locking assembly is disposed within a tamper resistant portion of the firearm.

13. The assembly of claim 1, wherein said locking assembly comprises a power source, said assembly further comprising an alternative power source, said assembly being operable to automatically switch between said power source and said alternative power.

14. The assembly of claim 1, wherein said locking assembly comprises a timing mechanism, said timing mechanism being operable to automatically actuate said safety assembly in accordance with predetermined programming.

15. The assembly of claim 1, wherein said locking assembly comprises a global positioning system, said global positioning system being operable to detect and/or broadcast a location of said firearm to a remote receiver when said firearm discharges, and/or when said firearm safety lever is pressed and/or when said firearm is moved.

16. The assembly of claim 1, wherein said locking assembly comprises an image recorder, said image recorder being operable to record at least one image.

17. An assembly comprising:

a firearm, said firearm having an interior within at least one of a grip and a stock said firearm including a trigger assembly having a trigger or a trigger together with a trigger bar, said trigger assembly being configured to be operable to actuate said firearm to discharge a projectile;

a safety assembly on the firearm and being configured to restrict access to said firearm, said safety assembly comprising an access code portion being configured to regulate access to said safety assembly, wherein said access code portion comprises a plurality of push buttons operable to generate an access code to operate the safety assembly and to access the safety assembly, said safety assembly further comprising a carriage within the interior including:

a processor operable to provide timing and code access programming for regulating said safety assembly;

a restriction portion movable within the interior; and a motor configured to advance said restriction portion to a locked position such that the restriction portion serves as a physical barrier to restrict and lock movement of the trigger assembly so as to prevent said trigger from being pulled, said locked position of the restriction portion further locking the carriage such that the carriage is locked within the interior of the grip, wherein said motor is further operable to retract said restriction portion to remove said physical barrier preventing said trigger from being pulled and unlocking the carriage of the safety assembly to enable removal of said carriage from the interior.

* * * * *